US011260654B2

(12) United States Patent
Uchida et al.

(10) Patent No.: US 11,260,654 B2
(45) Date of Patent: Mar. 1, 2022

(54) LIQUID EJECTING APPARATUS AND LIQUID EJECTING HEAD

(71) Applicant: SEIKO EPSON CORPORATION, Tokyo (JP)

(72) Inventors: Kazuaki Uchida, Fujimi-machi (JP); Shunya Fukuda, Azumino (JP); Junichi Sano, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/907,956

(22) Filed: Jun. 22, 2020

(65) Prior Publication Data

US 2020/0398558 A1 Dec. 24, 2020

(30) Foreign Application Priority Data

Jun. 24, 2019 (JP) ..... JP2019-116063

(51) Int. Cl.

| | |
|---|---|
| ***B41J 2/045*** | (2006.01) |
| ***B41J 2/14*** | (2006.01) |
| ***B41J 2/155*** | (2006.01) |

(52) U.S. Cl.
CPC ..... *B41J 2/04541* (2013.01); *B41J 2/04581* (2013.01); *B41J 2/14201* (2013.01); *B41J 2/155* (2013.01)

(58) Field of Classification Search
CPC ..... B41J 2/04541; B41J 2/04581; B41J 2/14201; B41J 2/155
See application file for complete search history.

(56) References Cited

U.S. PATENT DOCUMENTS

| | | | | |
|---|---|---|---|---|
| 6,106,094 | A * | 8/2000 | Otani | B41J 29/393 347/19 |
| 2003/0122885 | A1* | 7/2003 | Kobayashi | B41J 2/04588 347/9 |
| 2016/0089882 | A1* | 3/2016 | Ishida | B41J 2/2139 347/12 |

FOREIGN PATENT DOCUMENTS

| | | |
|---|---|---|
| JP | 2018-051782 | 4/2018 |

* cited by examiner

*Primary Examiner* — Jason S Uhlenhake
(74) *Attorney, Agent, or Firm* — Workman Nydegger

(57) ABSTRACT

The controller controls ejection of liquid such that the first and second nozzles eject liquid at the same timing and the first and third nozzles eject liquid at different timings.

14 Claims, 9 Drawing Sheets

LIQUID EJECTING APPARATUS AND LIQUID EJECTING HEAD

The present application is based on, and claims priority from JP Application Serial Number 2019-116063, filed Jun. 24, 2019, the disclosure of which is hereby incorporated by reference herein in its entirety.

BACKGROUND

1. Technical Field

The present disclosure relates to a liquid ejecting apparatus and a liquid ejecting head.

2. Related Art

In general, liquid ejecting heads ejecting liquid, such as ink, from a plurality of nozzles have been proposed. For example, JP-A-2018-51782 discloses a liquid ejecting head including a plurality of nozzle lines arranged at a certain interval. Ink is ejected from the individual nozzles of the nozzle lines to a recording medium transported in a transport direction intersecting with a direction in which the plurality of nozzle lines are arranged.

In recent years, there is a demand for improving resolution of dots in a transport direction. To address this demand, nozzles are diagonally aligned relative to a transport direction so that dots may be arranged with resolution higher than resolution of the alignment of the nozzles. However, with this configuration, the dots may be formed in positions considerably shifted from ideal positions in the transport direction.

SUMMARY

According to an aspect of the present disclosure, a liquid ejecting apparatus includes a first nozzle line including a plurality of nozzles ejecting liquid arranged in a first direction, a second nozzle line including a plurality of nozzles ejecting liquid arranged in the first direction, a moving mechanism configured to move at least the first and second nozzle lines or a recording medium in a second direction diagonally intersecting with the first direction, and a controller configured to control ejection of liquid such that the liquid is ejected from the first and second nozzle lines while the movement is performed by the moving mechanism. The first nozzle line includes a first nozzle. The second nozzle line includes a second nozzle positioned the same as the first nozzle in the second direction. The first nozzle line includes a third nozzle positioned different from the first nozzle in the first direction. The controller controls ejection of liquid such that the first and second nozzles eject liquid at the same timing and the first and third nozzles eject liquid at different timings.

DESCRIPTION OF EXEMPLARY EMBODIMENTS

A. First Embodiment

Figure 1:
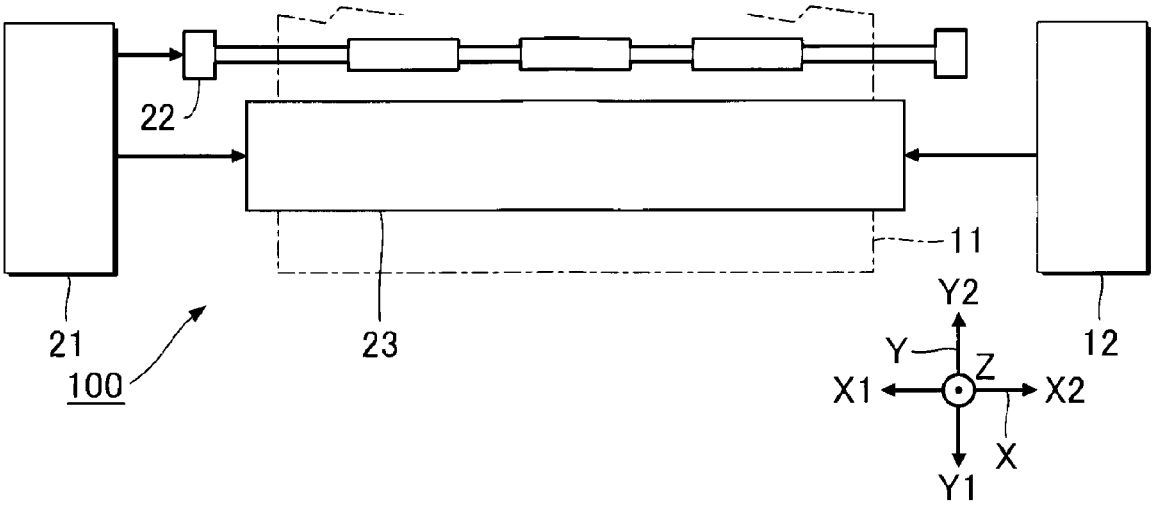
FIG. 1 is a diagram illustrating a configuration of a liquid ejecting apparatus according to a first embodiment.

FIG. 1 is a diagram illustrating a portion of a configuration of a liquid ejecting apparatus 100 according to a first embodiment. It is assumed that X, Y, and Z axes orthogonally intersect with one another as illustrated in FIG. 1 in description below. A direction along the X axis viewed from an arbitrary point is referred to as an X1 direction and a direction opposite to the X1 direction is referred to as an X2 direction. Similarly, directions opposite to each other along the Y axis viewed from the arbitrary point are referred to as a Y1 direction and a Y2 direction, and directions opposite to each other along the Z axis viewed from the arbitrary point are referred to as a Z1 direction and a Z2 direction. An X-Y plane including the X and Y axes corresponds to a horizontal plane. The Z axis extends along a vertical direction. Observation of a target in the Z direction is referred to as a "plan view" hereinafter.

The liquid ejecting apparatus 100 according to a first embodiment is an ink jet print apparatus ejecting ink droplets, which is an example of liquid, to a recording medium 11. Examples of the recording medium 11 include printing sheets. Note that printing targets of arbitrary material, such as a resin film or fabric, may be used as the recording medium 11.

As illustrated in FIG. 1, the liquid ejecting apparatus 100 includes a liquid container 12. The liquid container 12 stores ink. Examples of the liquid container 12 include a cartridge detachable from the liquid ejecting apparatus 100, a pouched ink pack formed of a flexible film, and an ink tank which may be filled with ink.

As illustrated in FIG. 1, the liquid ejecting apparatus 100 includes a control unit 21, a transport mechanism 22, and a liquid ejecting head 23. The control unit 21 controls components included in the liquid ejecting apparatus 100. The control unit 21 includes at least one processing circuit, such as a central processing unit (CPU) or a field programmable gate array (FPGA), and a storage circuit, such as a semiconductor memory. The CPU functions as a "controller" controlling the liquid ejecting head 23, and the storage circuit functions as a storage section storing various information.

The transport mechanism 22 transports the recording medium 11 along the Y axis under control of the control unit 21. The transport mechanism 22 is an example of a "moving mechanism". The liquid ejecting head 23 ejects ink supplied from the liquid container 12 to the recording medium 11 under control of the control unit 21. The liquid ejecting head 23 of the first embodiment is a line head extending in the X direction. When the liquid ejecting head 23 ejects ink to the recording medium 11 while the transport mechanism 22 transports the recording medium 11, a desired image is formed on a surface of the recording medium 11.

Figure 2:
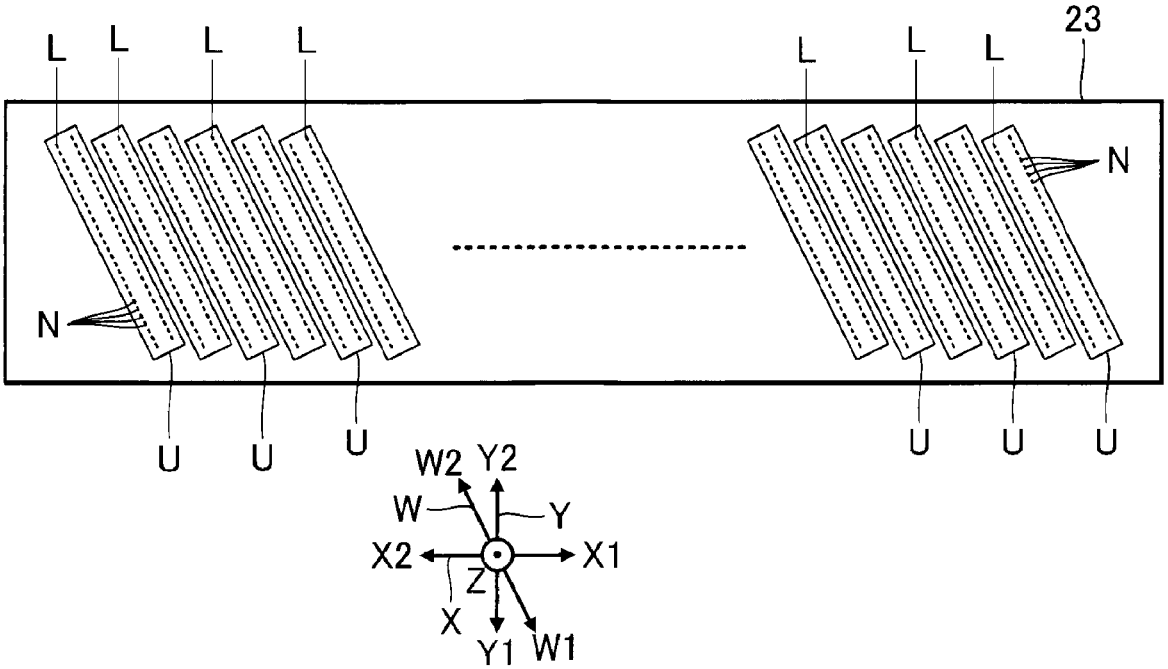
FIG. 2 is a plan view of a surface of a liquid ejecting head which faces a recording medium.

FIG. 2 is a plan view of a surface of the liquid ejecting head 23 which faces the recording medium 11. As illustrated in FIG. 2, the liquid ejecting head 23 includes a plurality of liquid ejecting units U arranged along the X axis. The number of liquid ejecting units U included in the liquid ejecting head 23 may be arbitrarily determined. Each of the liquid ejecting units U has a plurality of nozzles N. Note that the number of nozzles N included in each of the liquid ejecting units U may be arbitrarily determined.

The plurality of nozzles N of the liquid ejecting units U are arranged along a W axis. The W axis is inclined at a predetermined angle relative to the X axis or the Y axis in the X-Y plane. The predetermined angle may be arbitrarily set except for a right angle and may be an angle equal to or larger than 30 degrees and equal to or smaller than 60 degrees, for example. As described above, since the plurality of nozzles N are arranged along the W axis which inclines relative to the Y direction in which the recording medium 11 is transported according to the first embodiment, substantive resolution in the X direction may be enhanced when compared with a configuration in which the plurality of nozzles N are arranged along the X axis. Specifically, in the X direction, resolution between dots formed on the recording medium 11 may be enhanced when compared with resolution between dots of nozzles in a single nozzle line (described below). Note that the W direction is an example of a "first direction" and the Y direction is an example of a "second direction". Specifically, the transport mechanism 22 transports the recording medium 11 in the Y direction (the Y1 direction) intersecting with the W direction.

As illustrated in FIG. 2, the plurality of nozzles N of each of the liquid ejecting units U are divided into two or more nozzle lines L. In FIG. 2, a configuration in which the plurality of nozzles N of each of the liquid ejecting units U are divided into five nozzle lines L is illustrated. Specifically, the liquid ejecting head 23 has a plurality of nozzle lines L arranged at a predetermined interval along a direction orthogonal to the W direction. Each of the nozzle lines L includes the plurality of nozzles N arranged in the W direction. Specifically, the plurality of nozzles N included in each of the nozzle lines L are arranged in different positions in the W direction. Note that, although described in detail hereinafter, a plurality of nozzles N included in a single nozzle line L communicate with a single common liquid chamber.

Figure 3:
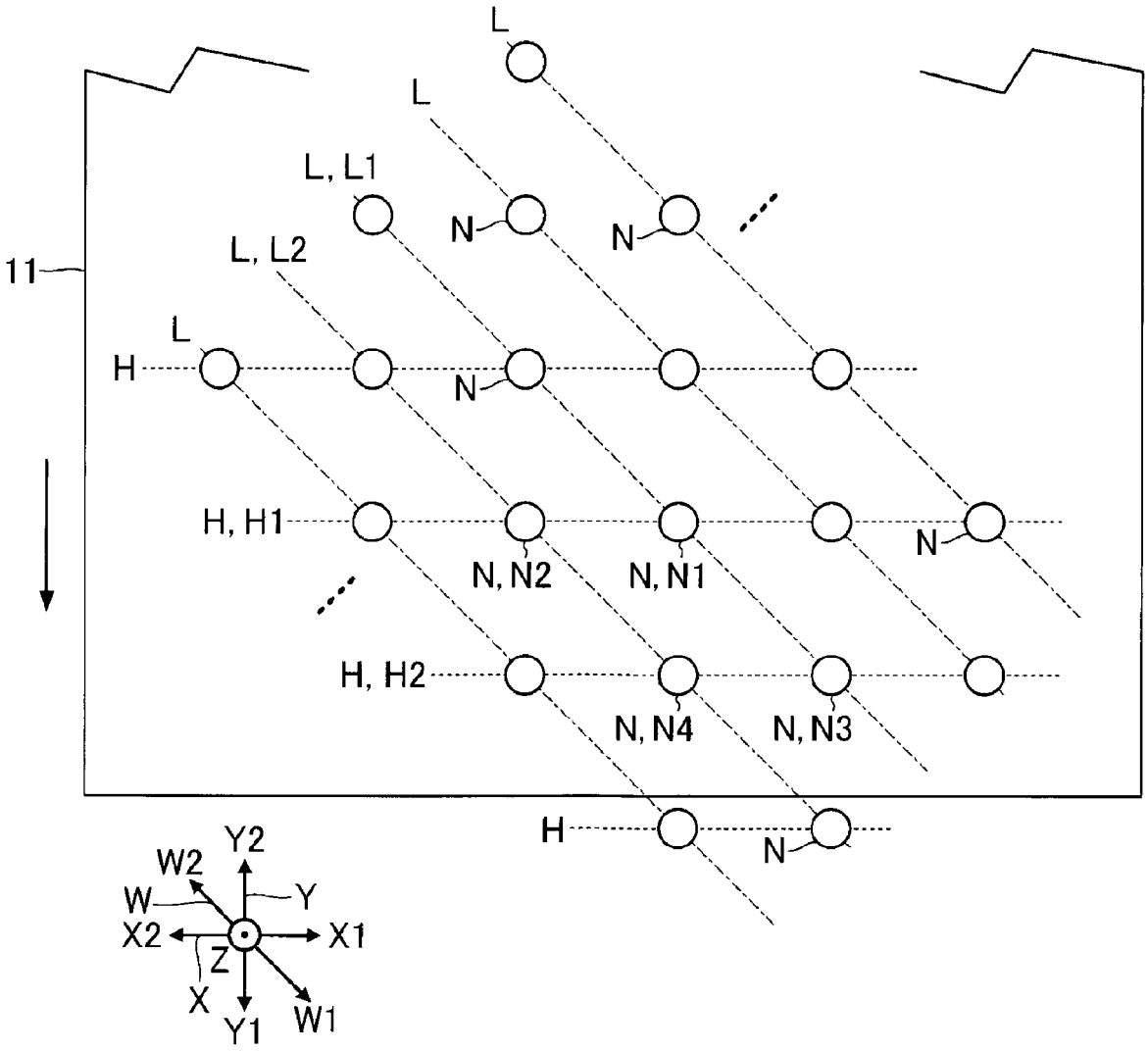
FIG. 3 is a plan view of a plurality of nozzles of the liquid ejecting head.

FIG. 3 is a plan view of the plurality of nozzle lines L included in the liquid ejecting head 23. As illustrated in FIGS. 2 and 3, the numbers of nozzles N and the intervals between the nozzles N in the individual nozzle lines L are the same. Furthermore, as illustrated in FIG. 3, positions of the nozzles N in the individual nozzle lines L in the Y direction are the same. Accordingly, the plurality of nozzles N of the liquid ejecting head 23 are divided by a plurality of nozzle rows H. Each of the nozzle rows H is a group of the plurality of nozzles N arranged in the X direction across the plurality of nozzle lines L. The plurality of nozzle rows H are arranged in the Y direction at an interval therebetween. In the description below, two of the nozzle rows H adjacent to each other in the Y direction are referred to as a "first nozzle row H1" and a "second nozzle row H2". For example, the first nozzle row H1 is an odd-numbered row and the second nozzle row H2 is an even-numbered row. In the first embodiment, the positions of the nozzles N included in the individual nozzle lines L in the X direction are also the same.

The control unit 21 controls ejection of ink for each nozzle row H. Specifically, the plurality of nozzles N included in each of the nozzle rows H simultaneously eject ink. The control unit 21 of the first embodiment performs control such that the nozzle rows H in the odd-numbered rows and the nozzle rows H in the even-numbered rows in the plurality of nozzle rows H alternately eject ink, for example. The odd-numbered nozzle rows H simultaneously eject ink and the even-numbered nozzle rows H simultaneously eject ink at a timing different from a timing when the odd-numbered nozzle rows H eject ink. Specifically, the control unit 21 performs control such that the first nozzle row H1 and the second nozzle row H2 eject liquid at different timings.

Figure 4:
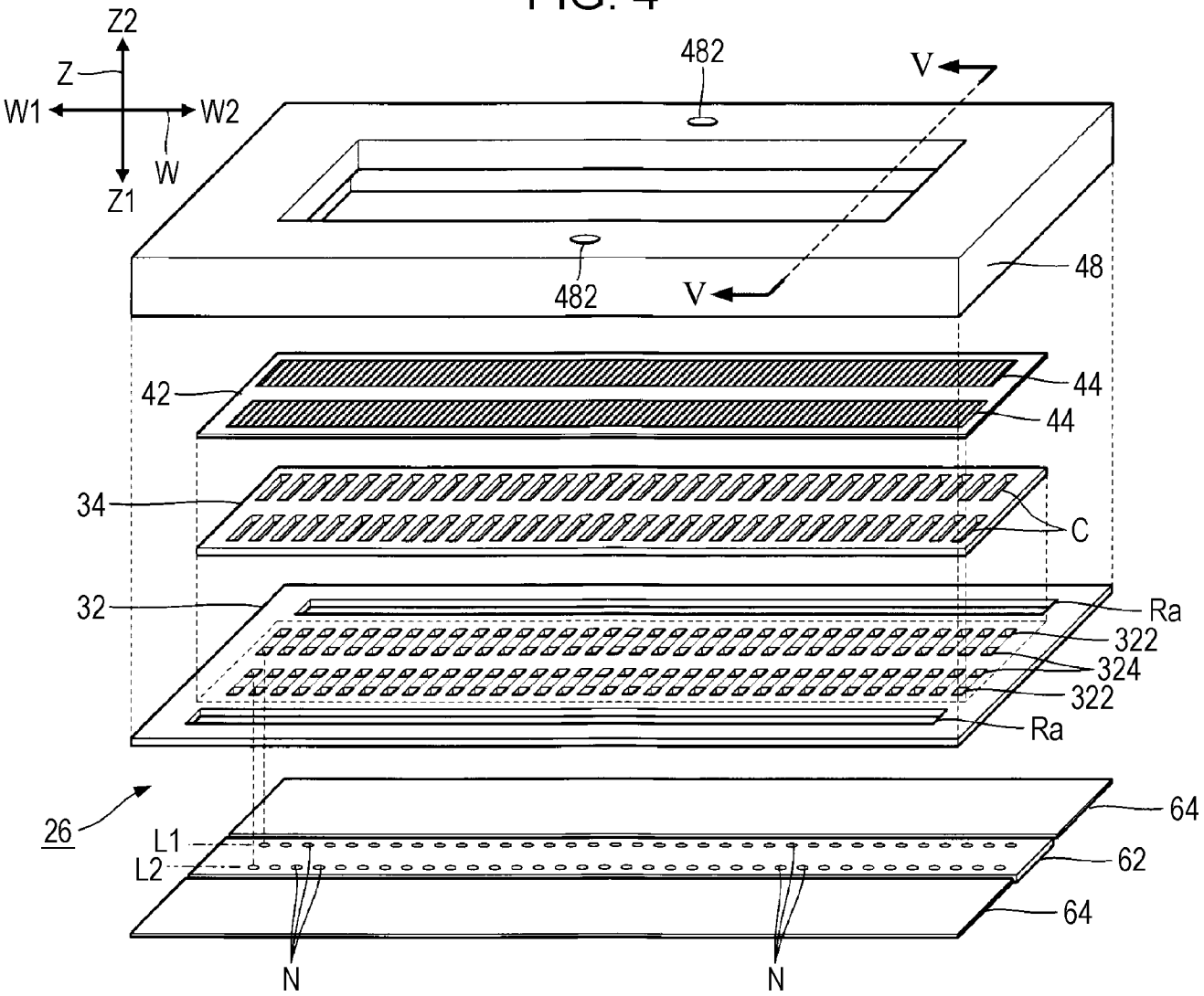
FIG. 4 is an exploded perspective view of a configuration of a liquid ejecting unit.
Figure 5:
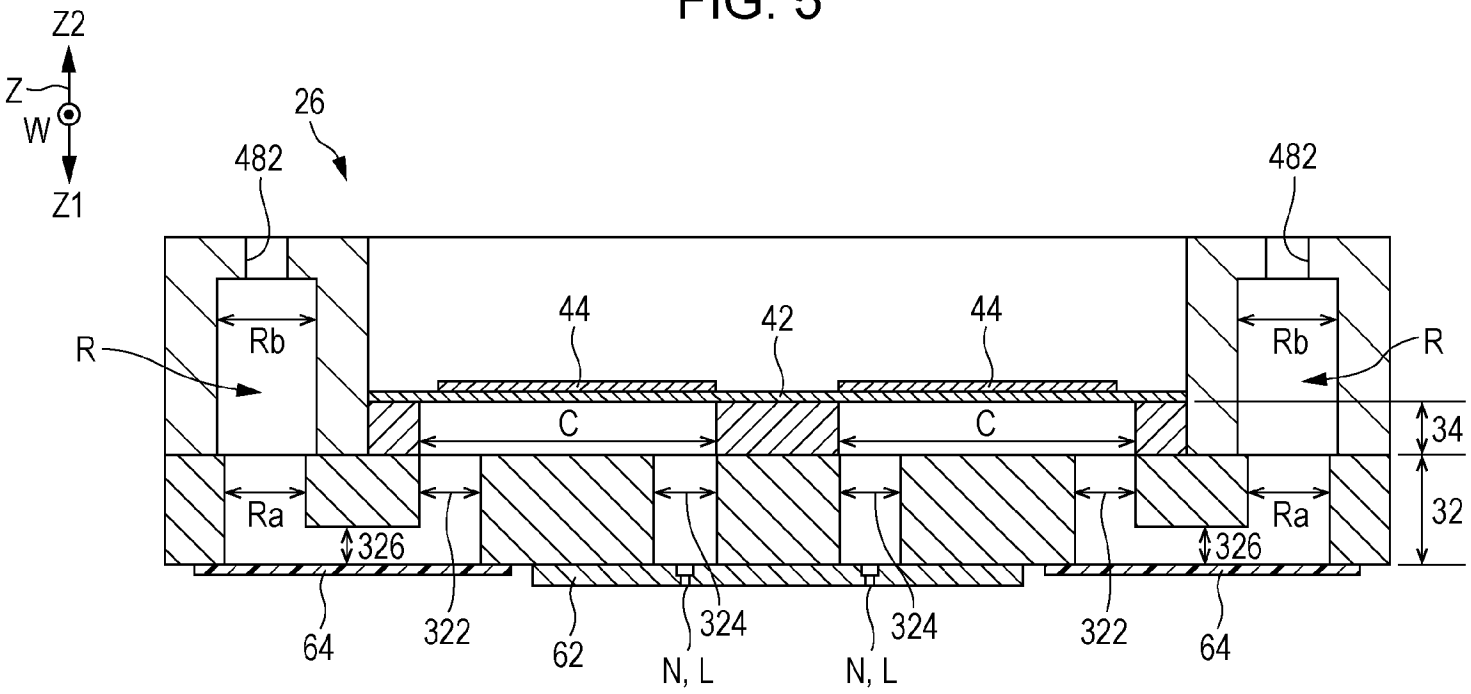
FIG. 5 is a cross-sectional view of the liquid ejecting head taken along a line V-V of FIG. 4.

FIG. 4 is an exploded perspective view of the liquid ejecting unit U, and FIG. 5 is a cross-sectional view taken along a line V-V of FIG. 4. As illustrated in FIG. 4, the liquid ejecting unit U includes the plurality of nozzles N arranged in the W direction. As is apparent from FIG. 5, the liquid ejecting unit U of the first embodiment is configured such that components associated with the nozzles N included in one of the nozzle lines and components associated with the nozzles N included in the other of the nozzle lines are arranged in a substantially symmetrical manner.

As illustrated in FIGS. 4 and 5, the liquid ejecting unit U includes a flow path substrate 32. As illustrated in FIG. 4, a pressure chamber substrate 34, a vibration plate 42, and a case section 48 are disposed in a negative direction of the Z axis of the flow path substrate 32. On the other hand, a nozzle plate 62 and vibration absorbers 64 are disposed in the Z1 direction of the flow path substrate 32. The components included in the liquid ejecting unit U are plate-like members substantially extending in the W direction and are coupled to each other using an adhesive agent, for example.

The nozzle plate 62 is a plate-like member including the plurality of nozzles N disposed thereon and is disposed on a surface of the flow path substrate 32 in the Z1 direction. Each of the plurality of nozzles N is a circular through hole in which the ink flows. The nozzle plate 62 of the first embodiment includes the plurality of nozzles N disposed thereon forming two nozzle lines. The nozzle plate 62 is fabricated by processing a silicon single-crystal substrate by means of a semiconductor fabrication technique, such as dry etching or wet etching, for example. Note that general material and a general fabrication method may be arbitrarily employed in the fabrication of the nozzle plate 62.

As illustrated in FIGS. 4 and 5, in the flow path substrate 32, a space Ra, a plurality of supply flow paths 322, a plurality of communication flow paths 324, and a supply liquid chamber 326 are formed for each of the two nozzle lines. The space Ra is an opening extending in the W direction in a plan view from the Z axis, and the supply flow paths 322 and the communication flow paths 324 are through holes formed for individual nozzles N. The supply liquid chamber 326 is a space extending in the W direction across the plurality of nozzles N and is used to communicate the space Ra with the plurality of supply flow paths 322. Each of the communication flow paths 324 overlaps with a corresponding one of the nozzles N in the plan view.

As illustrated in FIGS. 4 and 5, the pressure chamber substrate 34 is a plate-like member having a plurality of pressure chambers C corresponding to the two nozzle lines. The plurality of pressure chambers C are arranged in the W direction. The pressure chambers C are spaces formed for individual nozzles N and extend in the X direction in the plan view. The flow path substrate 32 and the pressure chamber substrate 34 are fabricated by processing a silicon single-crystal substrate by means of a semiconductor fabrication technique, for example, similarly to the nozzle plate 62 described above. Note that general material and a general method are arbitrarily employed in the fabrication of the flow path substrate 32 and the pressure chamber substrate 34.

As illustrated in FIG. 5, the vibration plate 42 is formed on a surface of the pressure chamber substrate 34 which is opposite to a surface facing the flow path substrate 32. The vibration plate 42 of the first embodiment is a plate-like member which may be elastically vibrated. Note that a portion of or entire vibration plate 42 may be integrally formed with the pressure chamber substrate 34 by selectively removing portions of a plate-like member having a certain thickness, the portions corresponding to the pressure chambers C, in the thickness direction.

The pressure chambers C are spaces positioned between the flow path substrate 32 and the vibration plate 42. The plurality of pressure chambers C are arranged in the W direction for each of the two nozzle lines. As illustrated in FIGS. 4 and 5, the pressure chambers C communicate with the communication flow paths 324 and the supply flow paths 322. Accordingly, the pressure chambers C communicate with the nozzles N through the communication flow paths 324 and communicate with the spaces Ra through the supply flow paths 322 and the supply liquid chambers 326.

Figure 6:
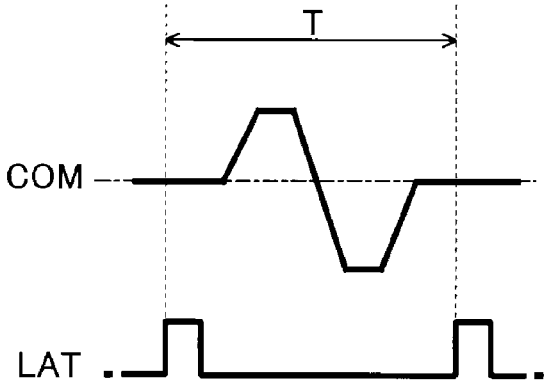
FIG. 6 is a waveform chart of a driving signal and a latch signal.

A plurality of piezoelectric elements 44 corresponding to the nozzles N are formed for the two nozzle lines on a surface of the vibration plate 42 which is opposite to a surface facing the pressure chambers C. The individual piezoelectric elements 44 are driving elements which change pressure of the pressure chambers C so that the ink is ejected from the nozzles N. The piezoelectric elements 44 are examples of the "energy generation elements". Specifically, the piezoelectric elements 44 are actuators deformed in accordance with a driving signal COM supplied from the control unit 21 and extend in a direction orthogonal to the W axis in the plan view, for example. As illustrated in FIG. 6, the driving signal COM is a voltage signal temporally changed in a predetermined cycle T using a constant reference voltage as a reference and includes a driving pulse every predetermined cycle T. Note that the driving signal COM may include a waveform having a plurality of driving pulses.

The plurality of piezoelectric elements 44 are arranged in the W direction so as to correspond to the plurality of pressure chambers C. When the vibration plate 42 is vibrated along with the deformation of the piezoelectric elements 44, pressure in the pressure chambers C is changed so that the ink included in the pressure chambers C is ejected through the communication flow paths 324 and the nozzles N.

Figure 7:
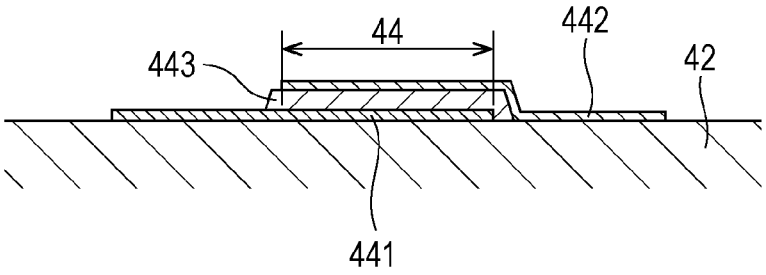
FIG. 7 is a cross-sectional view of a configuration of a piezoelectric element.

FIG. 7 is a cross-sectional view of one of the piezoelectric elements 44. As illustrated in FIG. 7, each of the piezoelectric elements 44 is a laminated body including a first electrode 441, a second electrode 442, and a piezoelectric layer 443 disposed between the first electrode 441 and the second electrode 442. The first electrode 441 is a discrete electrode formed for each piezoelectric element 44 on a surface of the vibration plate 42. The driving signal COM for each piezoelectric element 44 is supplied to the first electrode 441. The piezoelectric layer 443 is formed of piezoelectric material having ferroelectricity, such as lead zirconate titanate. The second electrode 442 is a common electrode which extends over a plurality of piezoelectric elements 44. A predetermined reference voltage is applied to the second electrode 442. Specifically, a voltage corresponding to a difference between the reference voltage and the driving signal COM is applied to the piezoelectric layer 443. A portion in which the first electrode 441, the second electrode 442, and the piezoelectric layer 443 overlap with one another in the plan view functions as the piezoelectric element 44. When the vibration plate 42 vibrates along with the deformation of the piezoelectric elements 44, pressure of the ink included in the pressure chambers C are changed and the ink included in the pressure chambers C is ejected to an outside through the communication flow paths 324 and the nozzles N. Note that a configuration in which the first electrode 441 serves as a common electrode and the second electrode 442 serves as a discrete electrode for each piezoelectric element 44 or a configuration in which both the first electrode 441 and the second electrode 442 serve as discrete electrodes may be employed. Furthermore, a voltage (the predetermined reference voltage) may not be applied to one of the first electrode 441 and the second electrode 442 which does not receive the driving signal COM.

As illustrated in FIGS. 4 and 5, the case section 48 is a case storing the ink to be supplied to the plurality of pressure chambers C. As illustrated in FIG. 5, the spaces Rb are formed for the corresponding two nozzle lines in the case section 48 according to the first embodiment. The spaces Rb of the case section 48 communicate with the corresponding spaces Ra of the flow path substrate 32. Spaces formed by the spaces Ra and the spaces Rb function as common liquid chambers R storing ink to be supplied to the plurality of pressure chambers C. The plurality of nozzles N included in the nozzle lines L communicate with the common liquid chambers R. Ink is supplied to the common liquid chambers R through inlets 482 formed on the case section 48.

The ink included in the common liquid chambers R is supplied to the pressure chambers C through the supply liquid chambers 326 and the supply flow paths 322. The vibration absorbers 64 are flexible films forming wall surfaces of the common liquid chambers R and absorb pressure changes in the ink included in the common liquid chambers R.

The driving signal COM for driving the piezoelectric elements 44 is supplied to the piezoelectric elements 44 from the control unit 21 through driving circuits. According to the first embodiment, the driving circuits are formed for individual nozzle rows H. Specifically, the liquid ejecting head 23 has a plurality of driving circuits corresponding to the plurality of nozzle rows H. For example, the driving circuits are disposed so as to face a surface of the vibration plate 42 at a certain interval over the plurality of liquid ejection units U. Each of the driving circuits outputs the driving signal COM under control of the control unit 21.

Figure 8:
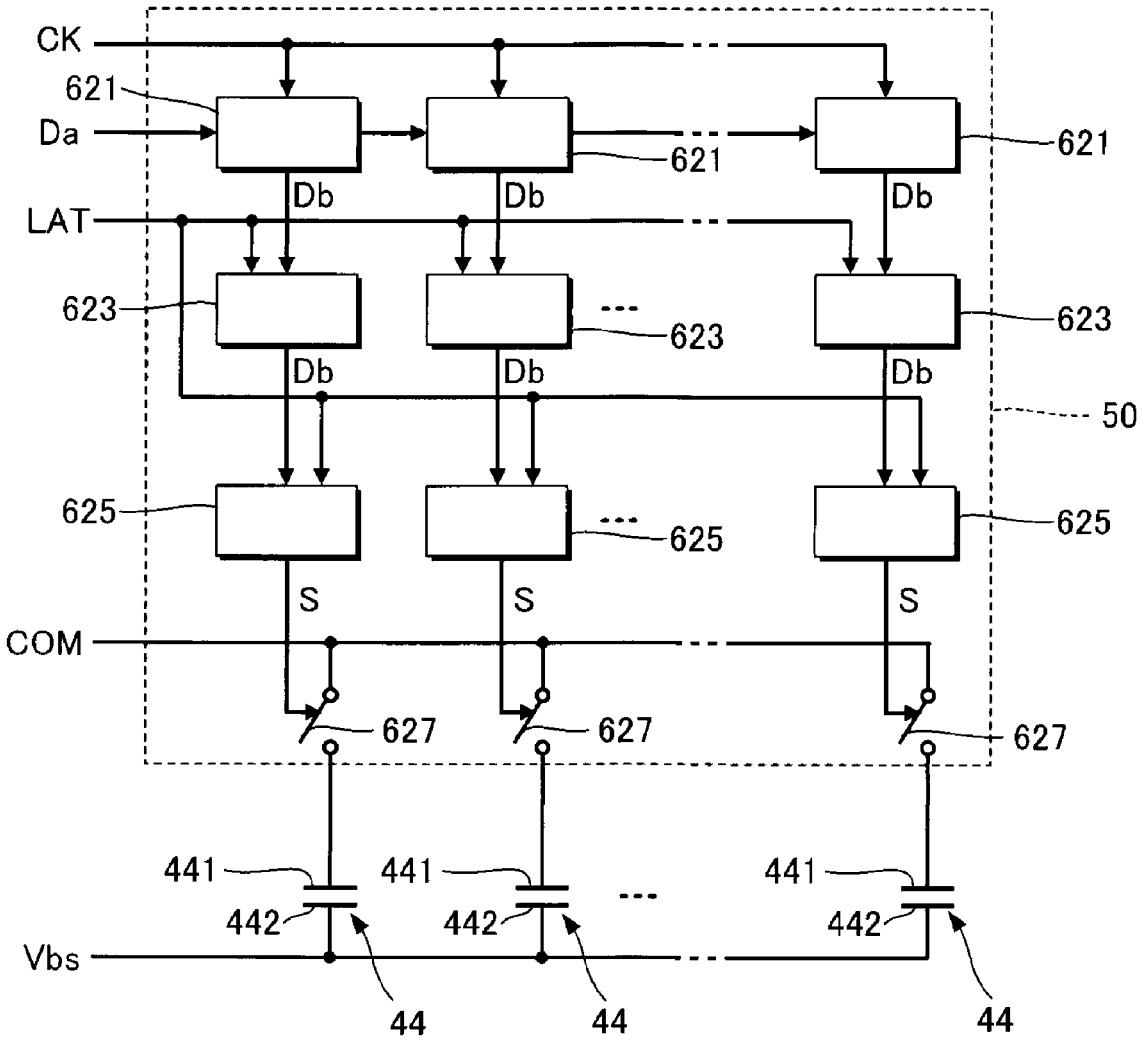
FIG. 8 is a block diagram illustrating a functional configuration of a driving circuit.

FIG. 8 is a block diagram illustrating a configuration of a driving circuit 50. As illustrated in FIG. 8, the driving circuit 50 includes shift registers 621, latch circuits 623, decoders 625, and switches 627 for individual piezoelectric elements 44 in the nozzle rows H.

A clock signal CK and input data Da are supplied to the shift registers 621. The clock signal CK has a level which is changed in a cycle sufficiently shorter than one cycle T of the driving signal COM illustrated in FIG. 6. The input data Da includes instruction data Db for specifying ejection/non-ejection of ink from the nozzles N for individual nozzles N included in the nozzle rows H. Specifically, the input data Da may include instruction data Db for individual piezoelectric elements 44 corresponding to the nozzles N included in the nozzle rows H. Specifically, the shift registers 621 shifts the input data Da to a later stage for each cycle of the clock signal CK so as to assign the instruction data Db to the individual piezoelectric elements 44.

The latch circuits 623 obtain the instruction data Db output from the shift registers 621 at a timing specified by a latch signal LAT and output the obtained instruction data Db. FIG. 6 includes a waveform chart of the latch signal LAT. In the latch signal LAT, a pulse is set in a cycle corresponding to the cycle T of the driving signal COM. As illustrated in FIG. 6, the pulse rises at a starting point of the cycle T. In the latch signal LAT, a period of time between two successive pulses corresponds to the cycle T. Specifically, the latch signal LAT may specify the cycle T of the driving signal COM.

The decoders 625 generate control signals S using the instruction data Db output from the latch circuits 623. Levels of the control signals S are determined at time points specified by the latch signal LAT. Specifically, the levels of the control signals S are determined at starting points of individual cycles T. More specifically, the decoders 625 set the control signals S to be a high level when the instruction data Db instructs ejection of ink and sets the control signals S to be a low level when the instruction data Db instructs non-ejection of ink.

The switches 627 are disposed between output terminals of the decoders 625 and first electrodes 441 of the piezoelectric elements 44. The control signals S output from the decoders 625 are supplied to control terminals of the switches 627. Each of the switches 627 is constituted by a transfer gate, for example, and determines whether the driving signal COM is to be supplied to a corresponding one of the piezoelectric elements 44 in accordance with the control signal S. When the control signal S is in a high level, a corresponding one of the switches 627 is controlled to be an ON state whereas when the control signal S is in a low level, a corresponding one of the switches 627 is controlled to be an OFF state. Specifically, the control signals S control ON/OFF of the switches 627. As is apparent from the foregoing description, ejection of ink from the nozzles N in each of the nozzle rows H is controlled at the cycle T specified by the common latch signal LAT.

Figure 9:
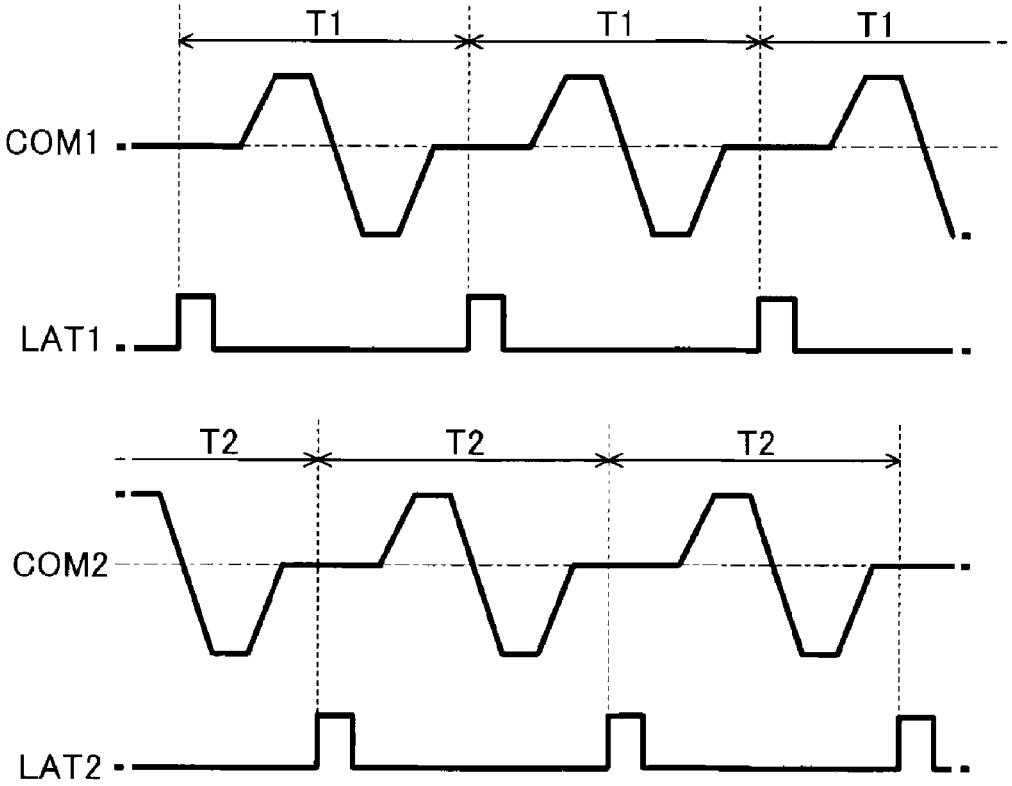
FIG. 9 is a waveform chart of driving signals and latch signals.

FIG. 9 is a diagram illustrating a driving signal COM1 and a latch signal (hereinafter referred to as a "first latch signal") LAT1 which are supplied to the driving circuit 50 disposed for the first nozzle row H1 and a driving signal COM2 and a latch signal (hereinafter referred to as a "second latch signal") LAT2 which are supplied to the driving circuit 50 disposed for the second nozzle row H2. The first latch signal LAT1 and the second latch signal LAT2 are examples of a "latch signal". As illustrated in FIG. 9, a cycle T1 specified by the first latch signal LAT1 and a cycle T2 specified by the second latch signal LAT2 are in different positioned in a temporal axis. Specifically, the cycle T1 of the first latch signal LAT1 is the same as the cycle T2 of the second latch signal LAT2, and a pulse of the second latch signal LAT2 is positioned between two successive pulses of the first latch signal LAT1. Specifically, a starting point of the cycle T2 is positioned between a starting point and an end point of the cycle T1. More specifically, the starting point of the cycle T2 is positioned in a middle point of the cycle T1. Accordingly, a timing when the individual nozzles included in the first nozzle row H1 eject ink and a timing when the nozzles included in the second nozzle row H2 eject ink are different. As is apparent from the foregoing description, the individual piezoelectric elements 44 included in the first nozzle row H1 are controlled based on the first latch signal LAT1 and the individual piezoelectric elements 44 included in the second nozzle row H2 are controlled based on the second latch signal LAT2. Therefore, the nozzles N included in the first nozzle row H1 eject ink at the same timing, and the nozzles N included in the second nozzle row H2 eject ink at a timing different from the timing of the first nozzle row H1. As illustrated in FIG. 9, the first nozzle row H and the second nozzle row H2 alternately eject ink.

As illustrated in FIG. 3, one of the two nozzle lines disposed adjacent to each other is referred to as a "first nozzle line L1" and the other is referred to as a "second nozzle line L2". A nozzle in the first nozzle row H1 and the first nozzle line L1 is referred to as a "first nozzle N1" and a nozzle N in the second nozzle row H2 and the first nozzle line L1 is referred to as a "third nozzle N3". Specifically, the first nozzle line L1 includes the first nozzle N1 and the third nozzle N3 in different positions in the W axis. Furthermore, a nozzle N in the first nozzle row H1 and the second nozzle line L2 is referred to as a "second nozzle N2" and a nozzle N in the second nozzle row H2 and the second nozzle line L2 is referred to as a "fourth nozzle N4". Specifically, the second nozzle line L2 includes the second nozzle N2 in a position the same as the first nozzle N1 in the Y direction and the fourth nozzle N4 in a position which is different from the second nozzle N2 in the W direction and which is the same as the third nozzle N3 in the Y direction. In the first embodiment, positions of the first nozzle N1 and the fourth nozzle N4 are the same as each other in the X direction. Note that the positions of the first nozzle N1 and the fourth nozzle N4 may be different from each other in the X direction.

As is apparent from the foregoing description, the control unit 21 is a component controlling ejection of ink such that the first nozzle N1 and the second nozzle N2 illustrated in FIG. 3 eject ink at the same timing and the first nozzle N1 and the third nozzle N3 eject liquid at different timings. Furthermore, the control unit 21 controls the ejection of ink such that the third nozzle N3 and the fourth nozzle N4 eject ink at the same timing.

The common liquid chamber R corresponding to the first nozzle line L1 is an example of a "first common liquid chamber", and the common liquid chamber R corresponding to the second nozzle line L2 is an example of a "second common liquid chamber". The piezoelectric element 44 corresponding to the first nozzle N1 is an example of a "first energy generation element", the piezoelectric element 44 corresponding to the second nozzle N2 is an example of a "second energy generation element", and the piezoelectric element 44 corresponding to the third nozzle N3 is an example of a "third energy generation element". Furthermore, the latch circuit 623 of the driving circuit 50 corresponding to the first nozzle row H1 is an example of a "first latch circuit", and the latch circuit 623 of the driving circuit 50 corresponding to the second nozzle row H2 is an example of a "second latch circuit". The first latch circuit corresponds to a component controlling the first energy generation element corresponding to the first nozzle N1 and the second energy generation element corresponding to the second nozzle N2 based on the first latch signal LAT1. The second latch circuit corresponds to a component controlling the third energy generation element corresponding to the third nozzle N3 based on the second latch signal LAT2 which is different from the first latch signal LAT1. The first latch circuit and the second latch circuit are individually disposed.

Here, a configuration in which the ejection of ink is controlled for individual nozzle lines L (hereinafter referred to as a "comparative example") is assumed, for example. In the comparative example, driving circuits are disposed for individual nozzle lines L. For example, a first latch circuit is coupled to the plurality of nozzles N (including the first nozzle N1 and the third nozzle N3) in the first nozzle line L1, and the common first latch signal LAT1 is supplied to the first latch circuit. Accordingly, the first nozzle N1 and the third nozzle N3 simultaneously eject ink. Furthermore, a second latch circuit is coupled to the plurality of nozzles N (including the second nozzle N2) in the second nozzle line L2, and the common second latch signal LAT2 is supplied to the second latch circuit. As described above, the first latch signal LAT1 and the second latch signal LAT2 have the same cycle but different starting points. Accordingly, the first nozzle N1 and the second nozzle N2 eject ink at different timings.

On the other hand, according to the first embodiment, the first nozzle row H1 and the second nozzle row H2 in FIG. 3 eject ink at different timings. Specifically, the first latch circuit is coupled to the plurality of nozzles N (including the first nozzle N1 and the second nozzle N2) included in the first nozzle row H1, and the common first latch signal LAT1 is supplied to the first latch circuit. Accordingly, the first nozzle N1 and the second nozzle N2 simultaneously eject ink. Furthermore, the second latch circuit is coupled to the plurality of nozzles N (including the third nozzle N3) included in the second nozzle row H2, and the common second latch signal LAT2 is supplied to the second latch circuit. Accordingly, the third nozzle N3 ejects ink at a timing different from the first nozzle N1. Specifically, the third nozzle N3 ejects ink after the first nozzle N1 and the second nozzle N2 eject ink and before the cycle T1 elapses, that is, the third nozzle N3 ejects ink at a timing when a half of the cycle T1 has elapsed.

Figure 10:
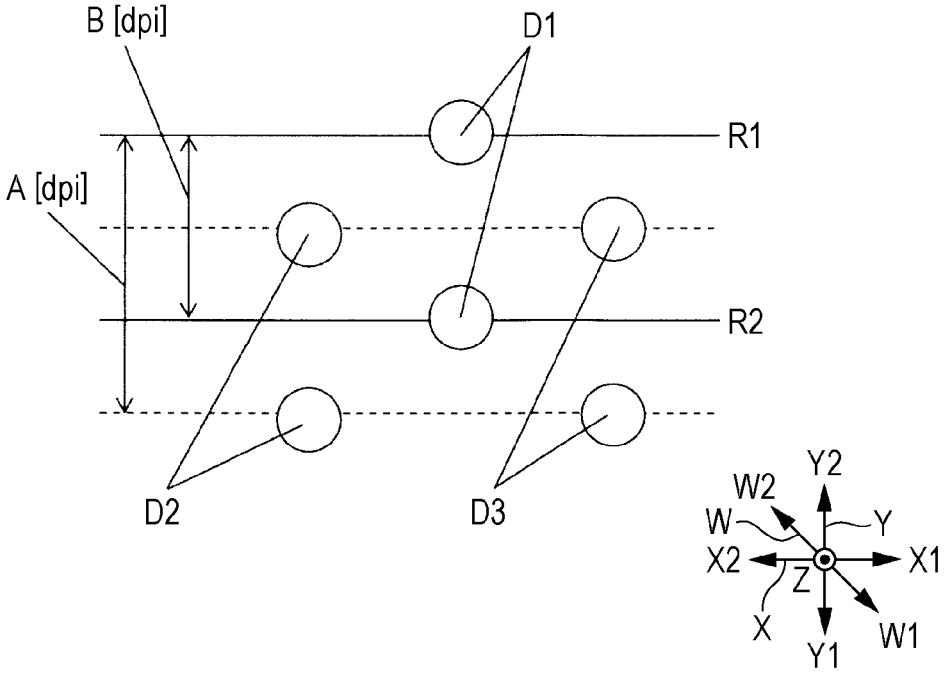
FIG. 10 is a diagram illustrating dots formed in a comparative example.
Figure 11:
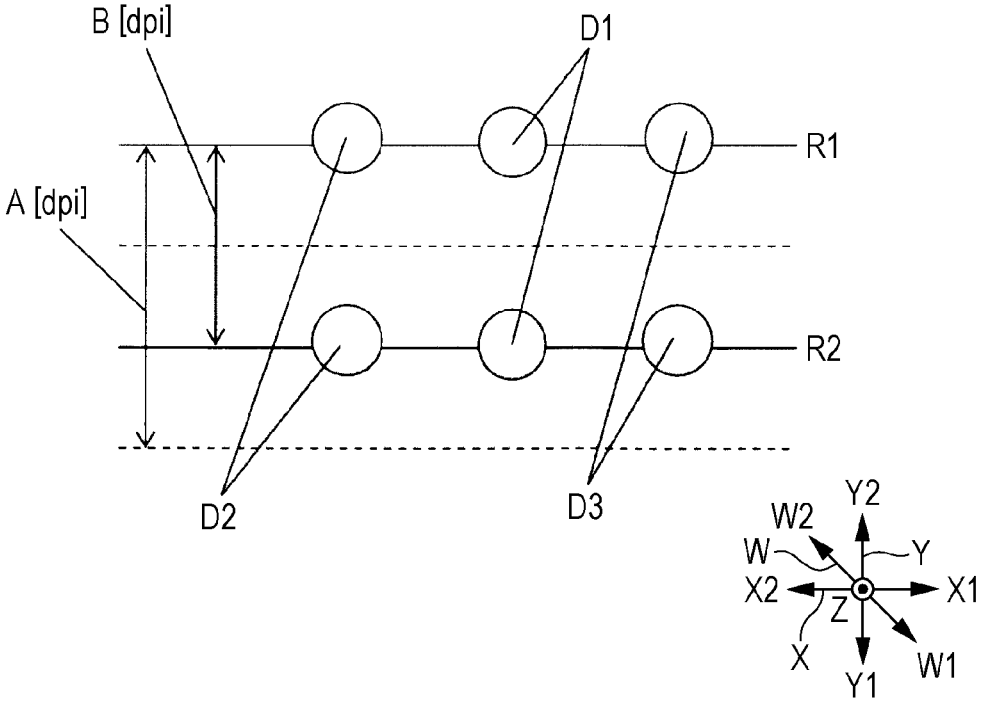
FIG. 11 is a diagram illustrating dots formed in the first embodiment.

Here, the first nozzle N1, the second nozzle N2, and the third nozzle N3 illustrated in FIG. 3 are focused. FIG. 10 is a diagram illustrating dots formed on a recording medium according to the comparative example, and FIG. 11 is a diagram illustrating dots formed on a recording medium according to the first embodiment. In FIGS. 10 and 11, dots formed by the first nozzle N1 are denoted by D1, dots formed by the second nozzle N2 are denoted by D2, and dots formed by the third nozzle N3 are denoted by D3. Furthermore, lines of raster to form dots (ideal positions) are denoted by R1 and R2.

Note that it is assumed that resolution in the Y direction of nozzles which are adjacent to each other in one nozzle line L (the first nozzle N1 and the third nozzle N3, for example) is denoted by A [dpi]. Furthermore, it is assumed that resolution of dots formed on a recording medium when ink is ejected in response to two successive first latch signals LAT1 from a certain nozzle is denoted by B [dpi]. In this case, since the cycle T2 of the second latch signal LAT2 is the same as the cycle T1 of the first latch signal LAT1, resolution of dots formed on a recording medium when ink is ejected in response to two successive second latch signals LAT2 from a certain nozzle is also B [dpi]. Furthermore, although an example in which "$B=A\times 2/3$" is satisfied is illustrated for simplicity of description, the same is true of the other examples, such as "$B=A\times 3/4$" and "$B=A\times 4/5$".

The dots formed in the comparative example will be described with reference to FIG. 10. First, the dots D1 are formed in the ideal positions by the first nozzle N1. The plurality of dots D1 of the first nozzle N1 are formed in the cycle T1 of the first latch signal LAT1, and therefore, an interval between the dots D1 of the first nozzle N1 is B [dpi]. Accordingly, the dots D1 of the first nozzle N1 are formed on the lines R1 and R2 of raster as illustrated in FIG. 10.

Subsequently, the third nozzle N3 is disposed in a position shifted from the first nozzle N1 by A [dpi] in a Y1 direction, and the third nozzle N3 and the first nozzle N1 eject ink at the same timing. Accordingly, the dots D3 of the third nozzle N3 are formed in positions shifted from the dots D1 of the first nozzle N1 by A [dpi] in the Y1 direction. Furthermore, the plurality of dots D3 of the third nozzle N3 are formed in the cycle T1 of the first latch signal LAT1, and therefore, an interval between the dots D3 of the third nozzle N3 is B [dpi]. Accordingly, the dots D3 of the third nozzle N3 are formed in positions other than the lines R1 and R2 of raster as illustrated in FIG. 10.

Although the second nozzle N2 and the first nozzle N1 are located in the same position in the Y direction, the dots D2 of the second nozzle N2 are formed in positions shifted from the dots D1 of the first nozzle N1 by $B\times 1/2$ [dpi] in the Y1 direction since the dots D2 are ejected in response to the second latch signal LAT2 (having a starting point in an intermediate point of the two first latch signals LAT1). Furthermore, although the plurality of dots D2 of the second nozzle N2 are formed in the cycle T2 of the second latch signal LAT2, an interval between the dots D2 of the second nozzle N2 is B [dpi] since the cycle T2 is equal to the cycle T1. Accordingly, the dots D2 of the second nozzle N2 are formed in positions other than the lines R1 and R2 of raster as illustrated in FIG. 10.

As described above, in the comparative example, a number of the dots (the dots D2 of the second nozzle N2 and the dots D3 of the third nozzle N3) are assigned to positions different from the ideal positions.

On the other hand, dots formed according to the first embodiment will be described with reference to FIG. 11. It is assumed first that the dots D1 of the first nozzle N1 are formed in the ideal positions. The dots D1 of the first nozzle N1 are formed on the lines R1 and R2 of raster similarly to the comparative example.

Thereafter, the third nozzle N3 is located in a position shifted from the first nozzle N1 by A [dpi] in the Y direction and performs ejection in response to the second latch signal LAT2. Accordingly, the dots D3 of the third nozzle N3 are formed in positions shifted from the dots D1 of the first nozzle N1 by A [dpi] in the Y1 direction in terms of the positions of the nozzles and by B/2 [dpi] in the Y2 direction in terms of the latch signal. Here, since "$B=A\times 2/3$" is satisfied, the dots D3 of the third nozzle N3 are located in positions shifted from the dots D1 of the first nozzle N1 by $A\times 2/3(=A-A\times 1/3)$ [dpi] in the Y1 direction. On the other hand, since the cycle T2 of the second latch signal LAT2 is the same as the cycle T1 of the first latch signal LAT1, the interval between the dots D3 of the third nozzle N3 is B [dpi]$=A\times 2/3$ [dpi]. Specifically, the dots D3 of the third nozzle N3 are formed in positions shifted in the Y1 direction from the dots D1 of the first nozzle N1 by 0 [dpi], $A\times 2/3$ [dpi], or the like as illustrated in FIG. 11. Accordingly, the dots D3 of the third nozzle N3 are formed on the lines R1 and R2 of raster.

The second nozzle N2 is located in a position the same as the first nozzle N1 in the Y direction and ejects liquid in response to the first latch signal LAT1. Therefore, as illustrated in FIG. 11, the arrangement of the dots D2 ejected from the second nozzle N2 in the Y direction is the same as the arrangement of the dots D1 of the first nozzle N1. Accordingly, the dots D2 of the second nozzle N2 are formed on the lines R1 and R2 of raster.

As described above, according to the first embodiment, the individual dots (the dots D1 of the first nozzle N1, the dots D2 of the second nozzle N2, and the dots D3 of the third nozzle N3) may be formed in the ideal positions.

As described above, the nozzles located in different positions in the Y direction (the first nozzle N1 and the third nozzle N3) are coupled to the single common liquid chamber R, and the nozzles located in the same position in the Y direction (the first nozzle N1 and the second nozzle N2) are coupled to the different common liquid chambers R. Therefore, the nozzles located in the same position in the Y direction (the first nozzle N1 and the second nozzle N2) may be coupled to a single latch circuit and may form dots in the same ideal positions in the Y direction by ejecting liquid at the same timing. Furthermore, the nozzles located in in positions different from each other in the Y direction (the first nozzle N1 and the third nozzle N3) are coupled to the different latch circuits and eject liquid at different timings. Here, the nozzles located in the different positions have different starting points of the two latch signals so that the nozzles may form dots in the same ideal position in the Y direction. By this, both the nozzles located in the same position in the Y direction and the nozzles located in the different positions in the Y direction may form dots in the same ideal positions.

Note that, although not described herein, the nozzles other than the first nozzle N1, the second nozzle N2, and the third nozzle N3 may have the configuration described in the foregoing embodiment. For example, since the fourth nozzle N4 is located in the same position as the third nozzle N3 in the Y direction, dots of the fourth nozzle N4 may be formed in the ideal positions when the fourth nozzle N4 is coupled to the latch circuit which is connected to the third nozzle N3 and ejects liquid at the same timing as the third nozzle N3.

B. Second Embodiment

A second embodiment of the present disclosure will be described. Note that components having functions the same as those of the components in the first embodiment are denoted by reference numerals the same as those used in the first embodiment in examples described below, and therefore, detailed descriptions thereof are appropriately omitted.

According to the second embodiment, a liquid ejecting apparatus 100 is used in fabrication of a color filter. A liquid ejecting head has a configuration the same as that of the first embodiment. A recording medium 11 according to the second embodiment includes a glass substrate and a black matrix BM formed on a surface of the glass substrate. The black matrix BM is a frame-like member formed of light-shielding material. The recording medium 11 is divided into a plurality of regions (hereinafter referred to as "pixel regions") G by the black matrix BM. The pixel regions G are portions in which the surface of the glass substrate is exposed on the glass substrate. Specifically, regions in which the black matrix BM is not formed on the glass substrate are the pixel regions G. The pixel regions G have a rectangle shape extending in an X direction, for example. The plurality of pixel regions G are arranged in a matrix.

A liquid ejecting head 23 ejects ink colored in red, blue, or green to each of the plurality of pixel regions G so as to generate a color filter. The ejected ink colors are different for individual pixel regions G.

According to the second embodiment, similarly to the first embodiment, a timing when a first nozzle row H1 ejects ink and a timing when a second nozzle row H2 ejects ink are different from each other. Specifically, the first nozzle row H1 and the second nozzle row H2 alternately eject ink. Similarly to the first embodiment, the first nozzle row H1 ejects ink in response to a first latch signal LAT1, and the second nozzle row H2 ejects ink in response to a second latch signal LAT2.

Figure 12:
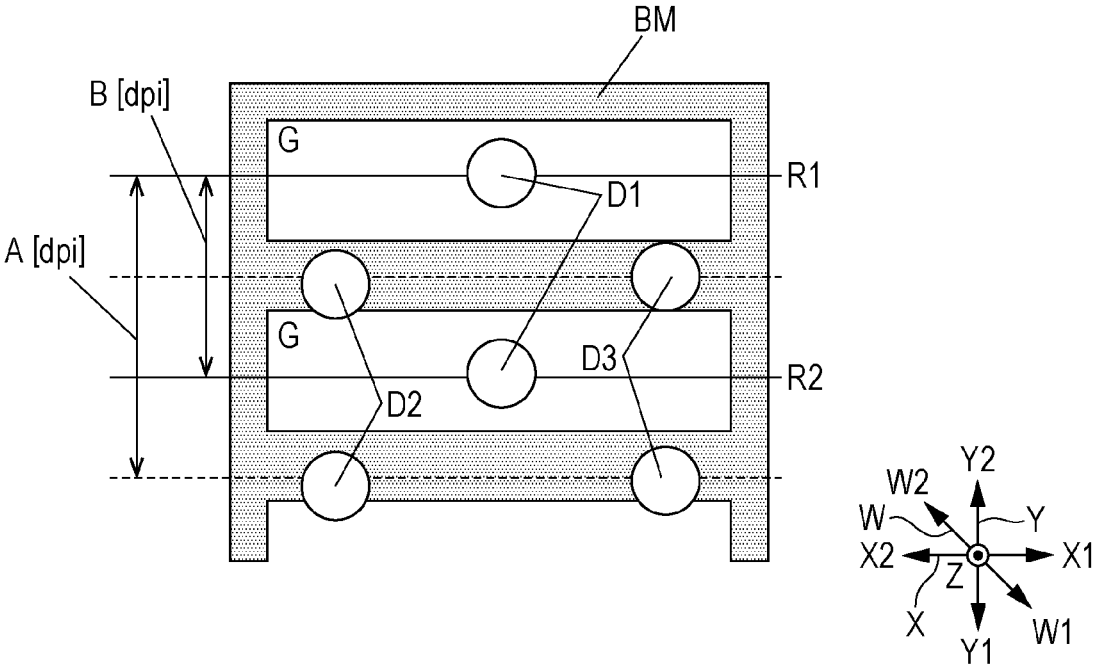
FIG. 12 is a diagram illustrating dots formed in the comparative example.
Figure 13:
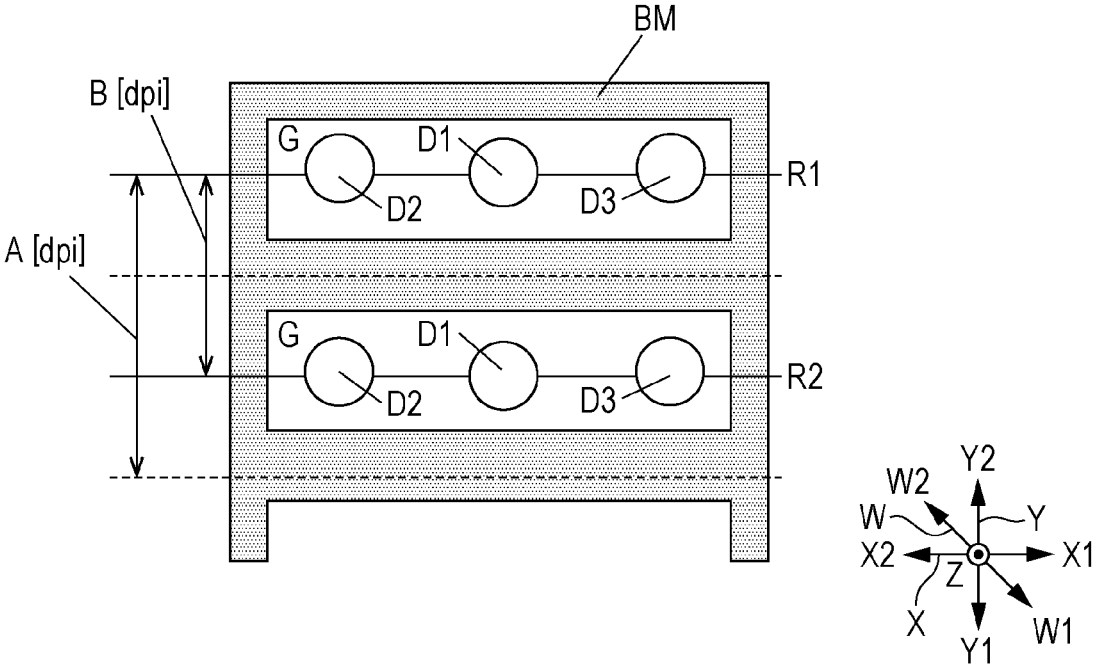
FIG. 13 is a diagram illustrating dots formed in a second embodiment.

FIG. 12 is a diagram illustrating dots formed on a recording medium according to the comparative example described above, and FIG. 13 is a diagram illustrating dots formed on a recording medium according to the second embodiment. A liquid ejecting head 23 and latch circuits coupled to the individual nozzles are the same as those of the first embodiment and the comparative example of the first embodiment, and therefore, arrangement of the dots in FIG. 12 is the same as that in FIG. 10 and arrangement of the dots in FIG. 13 is the same as that in FIG. 11.

Note that liquid is ejected within the pixel regions G to fabricate the color filter according to the second embodiment. In other words, pixels may not be formed when liquid is ejected on the black matrix BM, and the liquid does not contribute to light emission property of the color filter even when the liquid is ejected on the black matrix BM. Since a number of dots of the nozzles are formed on the black matrix BM as illustrated in FIG. 12 in the comparative example, the generated color filter may not have sufficient capability. On the other hand, individual dots may be formed within the pixel regions G according to the second embodiment, and therefore, a color filter having high light emission property may be fabricated.

The effect of the first embodiment is realized also in the second embodiment. The configuration in which the first nozzle N1 and the second nozzle N2 eject ink at the same timing and the third nozzle N3 and the fourth nozzle N4 eject ink at a timing different from the first nozzle N1 is appropriately used when ink is ejected and landed in a predetermined region, such as the pixel regions G extending in the X direction. Note that the configuration of the second embodiment is also appropriately used in fabrication of organic EL panels.

C. Modifications

The embodiments described above may be variously modified. Concrete modification modes to be applied to the foregoing embodiments will be illustrated hereinafter. Two or more modes arbitrarily selected from the examples below may be appropriately combined unless the modes do not contradict each other.

(1) Although two nozzle lines L which are adjacent to each other are illustrated as the first nozzle line L1 and the second nozzle line L2 according to the foregoing embodiments, arbitrary two nozzle lines L in the plurality of nozzle lines L included in the liquid ejecting head 23 may be employed as the first nozzle line L1 and the second nozzle line L2. Specifically, another nozzle line L may be arranged between the first nozzle line L and the second nozzle line L2. Specifically, the first nozzle N1 and the second nozzle N2 are included in the same nozzle row H, and may not be positioned adjacent to each other as long as timings of ejection of ink thereof are the same. Similarly, the third nozzle N3 and the fourth nozzle N4 are included in the same nozzle row H, and may not be positioned adjacent to each other as long as timings of ejection of ink thereof are the same.

Furthermore, the first nozzle row H1 and the second nozzle row H2 may not be positioned adjacent to each other. Specifically, the first nozzle N1 and the third nozzle N3 are included in the first nozzle line L1 and may not be positioned adjacent to each other as long as timings of ejection of ink thereof are different from each other. Similarly, the third nozzle N3 and the fourth nozzle N4 are included in the second nozzle line L2 and may not be positioned adjacent to each other as long as timings of ejection of ink thereof are different from each other.

(2) According to the foregoing embodiments, the timing when ink is ejected from the odd-numbered row H is different from the timing when ink is ejected from the even-numbered row H. However, the timings of ejection of ink from the individual nozzle rows H are not limited to the examples described above. For example, the timings when the ink is ejected from the individual nozzle rows H may be appropriately changed in accordance with content to be printed on the recording medium or a type of recording medium. Specifically, the first nozzle row H1 is not limited to the odd-numbered nozzle row H and the second nozzle row H2 is not limited to the even-numbered nozzle row H. The first nozzle row H1 and the second nozzle row H2 are examples of the two nozzle rows H having different timings when ink is ejected.

(3) Although the transport mechanism 22 transports the recording medium in the Y direction intersecting with the W direction according to the foregoing embodiments, a carriage may move the liquid ejecting head 23 in the Y direction. The moving mechanism is comprehensively represented as a component which moves at least the first and second nozzle lines L1 and L2 or the recording medium in the Y direction diagonally intersecting with the W direction, and examples of the moving mechanism include the transport mechanism 22 and the carriage.

(4) The energy generation elements to apply pressure in an inside of the pressure chambers C are not limited to the piezoelectric elements 44 illustrated in the foregoing embodiments. For example, heater elements which generate bubbles in the inside of the pressure chambers C by adding heat may be used as the energy generation elements. As is apparent from the foregoing examples, the energy generation elements are comprehensively represented as elements to apply pressure in insides of the pressure chambers C and any operation method and any concrete configuration may be employed.

(5) Although the liquid ejecting apparatus 100 employing a line method in which the plurality of nozzles N are distributed in an entire width of the recording medium 11 is illustrated in the foregoing embodiments, the present disclosure may be employed in a liquid ejecting apparatus of a serial method in which a carriage having a liquid ejecting unit U mounted thereon reciprocates.

(6) The liquid ejecting apparatus 100 illustrated in the foregoing embodiment may be employed in various apparatuses including facsimile apparatuses and photocopiers in addition to apparatuses dedicated for printing. However, usage of the liquid ejecting apparatus according to the present disclosure is not limited to printing. For example, a liquid ejecting apparatus ejecting colored solution is used as a fabrication apparatus which fabricates a color filter of a display apparatus, such as a liquid crystal display panel. Furthermore, the liquid ejecting apparatus ejecting solution of dielectric material is used as a fabrication apparatus which forms wiring and electrodes of a wiring substrate. Furthermore, a liquid ejecting apparatus ejecting organic solution associated with living bodies is used as a fabrication apparatus fabricating a bio chip, for example.

(7) Although a system in which the positions of the dots formed by the first nozzle row H1 are the same as the positions of the dots formed by the second nozzle row H2 in the Y direction is illustrated in the foregoing embodiments, the positions of the dots may be slightly different in the Y direction. In this case, an interval between the formed dots in the Y direction is smaller than the interval obtained when the first nozzle row H1 and the second nozzle row H2 simultaneously eject liquid.

(8) Although the system in which the two nozzle rows are coupled to the different latch circuits is illustrated in the foregoing embodiments, modifications may be made. For example, different latch circuits may be coupled to different nozzle rows.

What is claimed is:

1. A liquid ejecting apparatus, comprising:

a first nozzle line including a plurality of nozzles ejecting liquid arranged in a first direction;

a second nozzle line including a plurality of nozzles ejecting liquid arranged in the first direction;

a moving mechanism configured to move at least the first and second nozzle lines or a recording medium in a second direction diagonally intersecting with the first direction; and a controller configured to control ejection of liquid such that the liquid is ejected from the first and second nozzle lines while the movement is performed by the moving mechanism, wherein the first nozzle line includes a first nozzle, the second nozzle line includes a second nozzle positioned the same as the first nozzle in the second direction, the first nozzle line includes a third nozzle positioned different from the first nozzle in the first direction, and the controller controls ejection of liquid such that the first nozzle ejects liquid at a first timing to form a first dot, the second nozzle ejects liquid at the first timing to form a second dot, and the first and third nozzles eject liquid at a second timing that is different from the first timing to form a third dot, the liquid ejecting apparatus further comprising:

a first latch circuit configured to control a first energy generation element corresponding to the first nozzle and a second energy generation element corresponding to the second nozzle based on a latch signal, and a second latch circuit, which is different from the first latch circuit, configured to control a third energy generation element corresponding to the third nozzle based on a latch signal.

2. The liquid ejecting apparatus according to claim 1, wherein the second nozzle line includes a fourth nozzle positioned different from the second nozzle in the first direction and the same as the third nozzle in the second direction, and the controller controls ejection of liquid such that the third nozzle and the fourth nozzle eject liquid at the same timing.

3. The liquid ejecting apparatus according to claim 1, wherein the plurality of nozzles included in the first nozzle line communicate with a first common liquid chamber storing liquid, and the plurality of nozzles included in the second nozzle line communicate with a second common liquid chamber storing liquid which is different from the first chamber.

4. The liquid ejecting apparatus according to claim 1, wherein the liquid is ink of red, blue, or green.

5. The liquid ejecting apparatus according to claim 1, wherein the recording medium is divided into a plurality of regions by a frame member, and the controller controls ejection of liquid such that the liquid is ejected to regions in which the frame member is not formed.

6. The liquid ejecting apparatus according to claim 1, wherein the first nozzle and the third nozzle are adjoined to each other in the first nozzle line.

7. The liquid ejecting apparatus according to claim 1, wherein the controller controls ejection of liquid such that the first and third nozzles do not eject liquid at the same timing.

8. The liquid ejecting apparatus according to claim 1, wherein the controller controls ejection of liquid such that a position of the first dot in the second direction, a position of the second dot in the second direction, and a position of the third dot in the second direction are the same position.

9. A liquid ejecting head, comprising:

a first nozzle line including a plurality of nozzles ejecting liquid arranged in a first direction;

a second nozzle line including a plurality of nozzles ejecting liquid arranged in the first direction;

a first energy generation element corresponding to a first nozzle included in the first nozzle line;

a second energy generation element corresponding to a second nozzle which is included in the second nozzle line and which is positioned the same as the first nozzle in a second direction diagonally intersecting with the first direction;

a third energy generation element corresponding to a third nozzle which is included in the first nozzle line and which is positioned different from the first nozzle in the first direction;

a first latch circuit configured to control the first energy generation element and the second energy generation element based on a latch signal; and a second latch circuit, which is different from the first latch circuit, configured to control the third energy generation element based on a latch signal.

10. A liquid ejecting apparatus, comprising:

the liquid ejecting head according to claim 9; and a controller configured to control ejection of liquid from the liquid ejecting head.

11. The liquid ejecting head according to claim 9, further comprising a fourth energy generation element corresponding to a fourth nozzle which is included in the second nozzle line and which is positioned different from the second nozzle in the first direction and the same as the third nozzle in the second direction, and the second latch circuit further control the fourth energy generation element based on the latch signal.

12. The liquid ejecting head according to claim 9, wherein the plurality of nozzles included in the first nozzle line communicate with a first common liquid chamber storing liquid, and the plurality of nozzles included in the second nozzle line communicate with a second common liquid chamber storing liquid which is different from the first chamber.

13. The liquid ejecting head according to claim 9, wherein the first nozzle and the third nozzle are adjoined to each other in the first nozzle line.

14. The liquid ejecting head according to claim 9, wherein the liquid is ink of red, blue, or green.

* * * * *